US006422731B2

(12) United States Patent
Weber

(10) Patent No.: US 6,422,731 B2
(45) **Date of Patent: *Jul. 23, 2002**

(54) METHOD FOR PROVIDING PASTE-LIKE BUILDING MATERIAL

(75) Inventor: Hans Richard Weber, Waldshut-Tiengen (DE)

(73) Assignee: INOTEC GmbH Transport-und Fördersysteme, Waldshut-Tiengen (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/305,911

(22) Filed: May 5, 1999

(30) Foreign Application Priority Data

May 5, 1998 (DE) ..... 298 08 023 U

(51) Int. Cl.[7] ..... B01F 3/10
(52) U.S. Cl. ..... 366/8; 366/51
(58) Field of Search ..... 366/19, 40, 50, 366/51, 64, 66, 8, 16, 21

(56) References Cited

U.S. PATENT DOCUMENTS

| | | | | |
|---|---|---|---|---|
| 2,354,634 | A | | 7/1944 | Griswold |
| 3,230,589 | A | * | 1/1966 | McIlvaine |
| 4,223,996 | A | * | 9/1980 | Mathis et al. |
| 4,431,310 | A | | 2/1984 | Ito et al. |
| 4,654,802 | A | * | 3/1987 | Davis |
| 5,470,147 | A | * | 11/1995 | Duckworth |
| 5,624,183 | A | * | 4/1997 | Schuff |
| 5,713,663 | A | * | 2/1998 | Zandberg et al. |

FOREIGN PATENT DOCUMENTS

| | | |
|---|---|---|
| DE | 2 323 196 | 11/1974 |
| DE | 29 47 913 | 6/1981 |
| DE | 30 41 107 | 5/1982 |
| DE | 31 04 751 | 8/1982 |
| DE | 36 30 301 | 3/1988 |
| DE | 88 10 499.0 | 11/1988 |
| DE | 38 09 661 | 10/1989 |
| DE | 93 19 066 | 2/1994 |
| DE | 43 35 331 | 4/1995 |
| DE | 44 08 659 | 9/1995 |
| DE | 197 23 474 | 12/1998 |
| EP | 239 685 | 10/1987 |
| EP | 530 510 | 3/1993 |
| FR | 2 503 618 | 10/1982 |

OTHER PUBLICATIONS

Palotas–Balazs: Beton–habares–keramia–muanyag, Akademiai Kiado, Budapest, 1980, Különösen 23, es 407–408, oldalak.

* cited by examiner

*Primary Examiner*—Charles E. Cooley
*Assistant Examiner*—David Sorkin
(74) *Attorney, Agent, or Firm*—Gudrun E. Huckett

(57) ABSTRACT

The invention relates to a method and a device for providing at construction sites paste-like building materials, especially mortar, being delivered in a fixedly pre-determined basic consistency. A conveying and mixing pump with an additional water supply opening is provided below the storage container for the paste-like building material. By means of the water supply opening, additional water is mixed with the mortar in order to produce the desired mortar consistency. For this purpose, a mixing portion having hedgehog-type mixing elements is provided.

2 Claims, 3 Drawing Sheets

METHOD FOR PROVIDING PASTE-LIKE BUILDING MATERIAL

BACKGROUND OF THE INVENTION

The present invention relates to a method for providing paste-like building materials, especially mortar, at construction sites. The invention further relates to a device for implementing the method by providing a storage container for the paste-like building material having a fixedly pre-determined basic consistency, a conveying and mixing pump arranged downstream and a water supply opening for feeding additional water in order to decrease the viscosity of the paste-like building material.

Factory mortar (or similar paste-like material) is transported by means of containers for mortar from the production place to the construction site where it is processed. However, because the production sites can produce the mortar with a standard consistency only and the respective application method is not known (for example, the temperature of the application surface, the application skills of the construction workers, etc.) the mortar with its consistency as delivered has to be worked with on the construction site. This can result in a poor plastering quality. In order to be able to alter the mortar consistency, additional water can be initially supplied to the container by means of buckets or a hose, however, a burdensome mixing with a manual mixing device has to be performed subsequently. If too much water is added by mistake, the mortar cannot be used any more.

Based on this background, it is an object of the invention to create a method for providing paste-like building materials, especially mortar, at construction sites, with which the consistency of the paste-like building material to be worked with can be increased; furthermore, a device for implementing the method shall be created.

SUMMARY OF THE INVENTION

This object is solved with respect to the inventive method by feeding additional water amounts to a fixedly pre-determined basic consistency of a paste-like building material in order to decrease the viscosity of the paste-like building material in order to create the desired consistency.

With the inventive method, paste-like building materials, especially paste-like mortar are still being delivered to construction sites in this paste-like consistency, however, the inventive idea is to feed additional water to the mortar at the location of processing the mortar in order to adjust the consistency of the mortar and in order to warrant the micro structural logistics from the mortar container to the facade by means of this subsequent water supply operation at the construction site. In this manner, the mortar that is produced with a standard consistency can be adjusted to the respective processing method by subsequently adding specific amounts of water, it can be adjusted, for example, to the temperature of the application surface of the mortar and the processing skills of the construction worker. In this manner, the respectively desired mortar consistency can be automatically produced in a flexible way and without any great efforts by means of the inventive method by injecting additional water at the construction site.

A further development of the inventive method provides that the water added to the paste-like building material at the construction site is continuously added and mixed to the material and the material is continuously conveyed toward a discharge opening. This further development has the advantage that it enables a continuous process of continuously providing paste-like building materials, especially mortar, of a respectively desired consistency.

The object is solved with respect to the device by providing a storage container for the paste-like building material having a fixedly pre-determined basic consistency, a conveying and mixing pump arranged downstream and a water supply opening for feeding additional water in order to decrease the viscosity of the paste-like building material.

By means of the inventive container for the mortar, paste-like building materials, especially paste-like mortar are still, as has already been described, being delivered to construction sites in this paste-like consistency, however, the inventive idea is to feed additional water to the mortar at the location of processing the mortar while it is being taken from the container in order to adjust the consistency of the mortar. The integrated mortar pump unit is thus provided with an additional water injection device with a water metering device arranged upstream for warranting the micro structural logistics from the mortar container to the facade by this subsequent water feeding at the construction site.

Another embodiment provides that the conveying and mixing pump is arranged below the storage container. This embodiment has the advantage that the paste-like building material can flow downwardly directly into the conveying and mixing pump where the additional water feeding occurs.

All aggregates of the conveying and mixing pump are provided within the long, tube-shaped part of another embodiment. The electric motor is preferably arranged at that end of the tube which lies opposite the distribution end.

Because the conveying and mixing pump according to another embodiment is positioned below the storage container 2 and does not exceed the dimensions thereof, shipping damages are prevented and an easier handling is warranted.

Another embodiment provides that the conveying and mixing pump is provided with a shaft is arranged in a casing and has conveying and mixing elements. These conveying and mixing elements can be optimized with respect to their application purpose. In particular, the conveying and mixing elements can be provided with a common shaft, which results in an overall simple structure.

In another preferred embodiment the conveying and mixing pump is provided in a discharge area of the storage container with sequential pump portions comprising a conveying portion with conveying elements for receiving the paste-like building material from the storage container and an adjacent mixing portion provided with the water supply opening and with mixing elements. Preferably, the mixing portion lies within the last third of the entirety of the pump portions. The mixing elements can be shaped hedgehog-like. In order to feed the extremely low amounts of water that have to be added to the paste-like mortar for altering its consistency in a continuously pumping process, the conveying and mixing pump is provided with a mixing portion specifically designed for that purpose to which the mortar to be altered is being added and being conveyed thereto from the conveying portion. The hedgehog-type mixing elements on the hedgehog-type shaft of the last third of the entirety of the portions formed of conveying and mixing portion warrant a quick feeding of the water into the mortar that passes through. In this manner, the mortar, altered in its consistency, leaves the conveying and mixing pump at a high uniformity and can be processed from there.

In another embodiment, the consistency-altered mortar is pressed through the third distribution portion and the uniform consistency of the mortar is thereby increased. The distribution opening for the paste-like mortar is adjacent to the distribution portion. For example, the mortar can be distributed by means of a hose.

Another preferred embodiment suggests that the water supply opening is provided with a water metering device having needle valves. The claim of the inventive method for optimizing the consistency of the mortar consists in only a very low amount of water of approximately 10 to 20 liters per hour to be required in the case of a mortar container having a volume of 1 to 2 $m^3$. In order to be able to add this extremely low water quantity to the mortar in a continuous pumping process, the installed water metering device is provided with very small dimensioned needle valves at flow meters with which it is possible to feed the low water quantities to the mortar passing through the conveying and mixing pump. During the pumping action, the water is being fed by means of a hose automatically via the water metering device and a control unit.

Finally, an over-dosing of water is prevented by another embodiment according to which the means for the introduction of water into the conveying and mixing pump is stopped simultaneously with stopping the conveying and mixing pump.

BRIEF DESCRIPTION OF THE DRAWINGS

The object and advantages of the present invention will appear more clearly from the following specification in conjunction with the accompanying drawings, in which.

DESCRIPTION OF PREFERRED EMBODIMENTS

Figure 1:
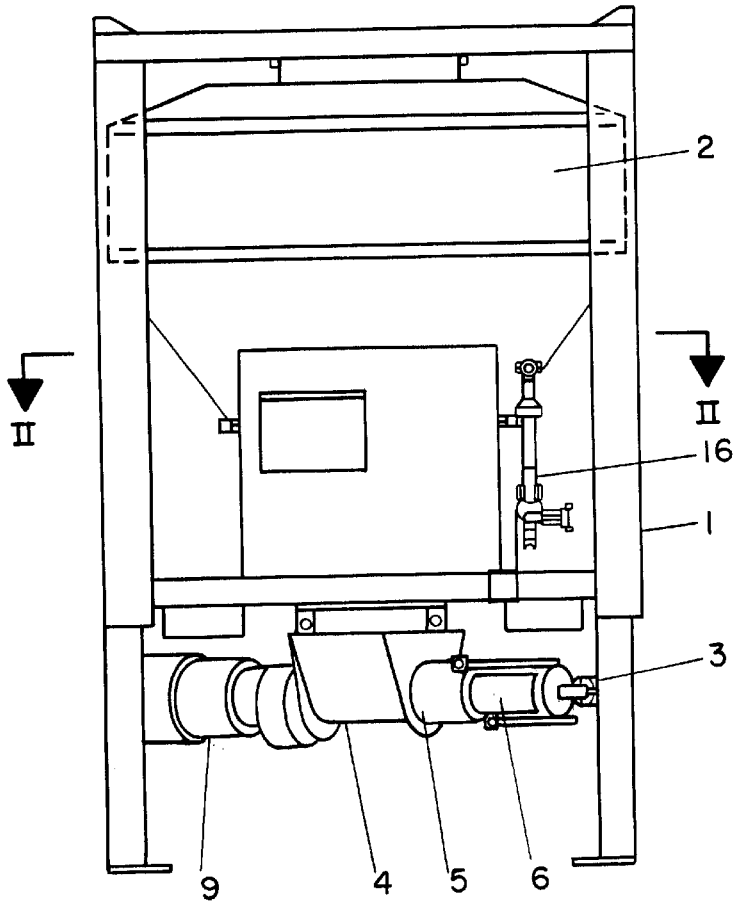
FIG. 1 shows a front view of the mortar container.
Figure 2:
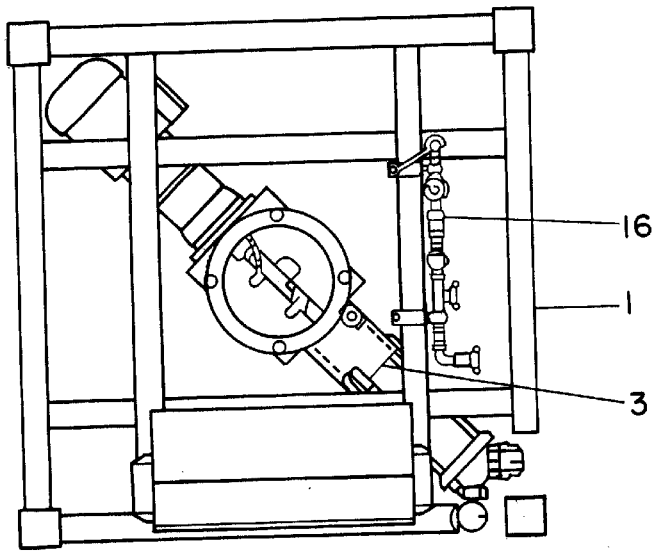
FIG. 2 shows a cross-sectional view along line II—II of FIG. 1 (however, without storage container and shutter)

The present invention will now be described in detail with the aid of several specific embodiments utilizing FIGS. 1 through 6.

The container for mortar is provided with a square framing 1 in the interior of which a funnel-shaped storage container 2 is positioned. This storage container 2 can be charged with mortar from above. A circular distribution opening is provided at the lower surface of the storage container 2 and can be closed off by means of a shutter.

A conveying and mixing pump 3 is attached at this lower distribution opening of the storage container 2 for the mortar. This conveying and mixing pump 3 is provided below the discharge area of the storage container 2 with a pan-shaped casing 4 which has an essentially V-shaped cross-section and which in its lower portion, starting at the inclined side walls, has a tangential transition to form a partial cylinder jacket. A tube 5 is provided at one face of the casing 4. A pipe 6 is connected via a flange with the tube 5. A distribution opening 7 is provided at the front end of the pipe 6.

A shaft 8 is provided within the casing 4 and also within the tube 5 and the pipe 6. This shaft 8 is driven by an electric motor 9 which is positioned at the other side of the casing 4.

Figure 4:
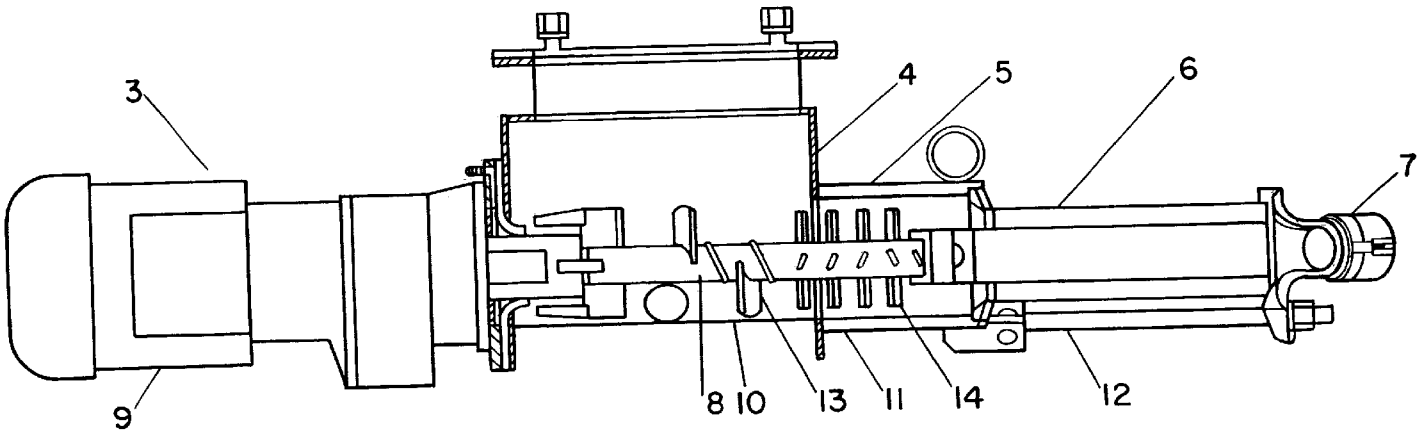
FIG. 4 shows a cross-sectional view along line IV—IV of FIG. 3.
Figure 3:
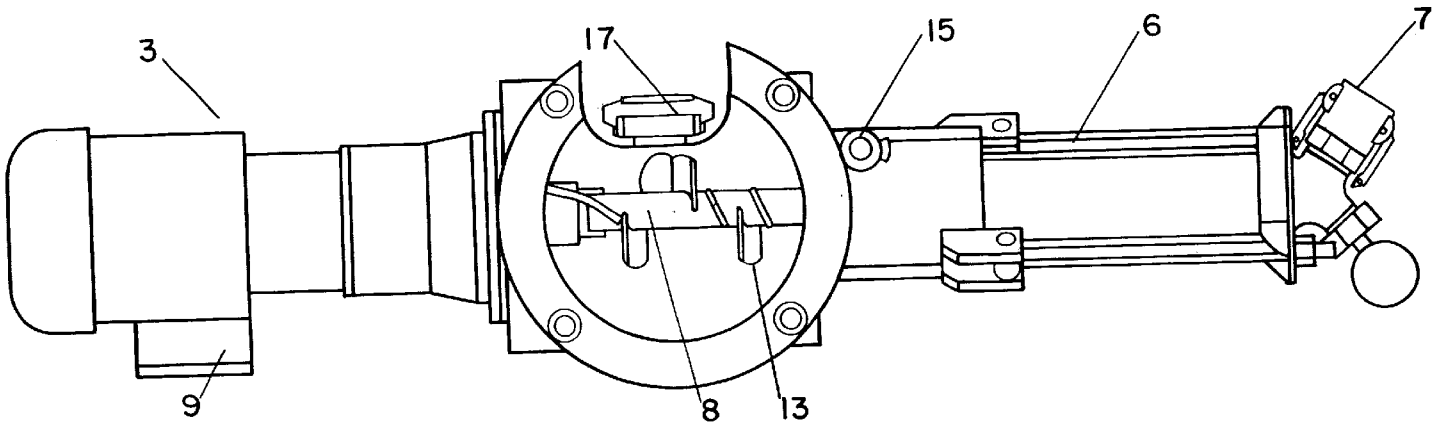
FIG. 3 shows a plan view of the conveying and mixing pump in an enlarged view relative to FIG. 2.
Figure 6:
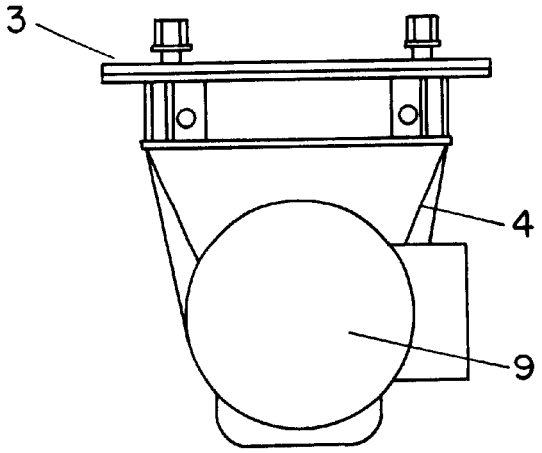
FIG. 6 shows a view of the pump of FIG. 4, as viewed from the left hand side.
Figure 5:
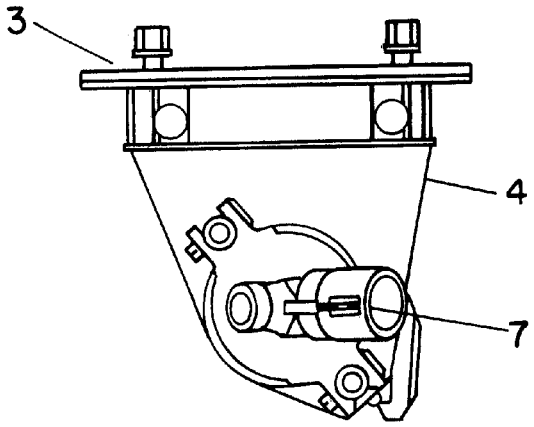
FIG. 5 shows a view of the pump of FIG. 4 from the right hand side.

The conveying and mixing pump 3 is partitioned into three portions, namely, into a first conveying portion 10 in the area of the pan-shaped casing 4, a mixing portion 11 in the area of the tube 5, and a distribution portion 12 in the area of the pipe 6. The shaft 8 of the conveying portion 10 is provided with wing-shaped conveying elements 13 which are positioned at an angle relative to the cross-section of the shaft 8. These wing-shaped conveying elements 13 have a relatively large width, i.e., they extend across the entire diameter of the shaft 8 as is shown in FIGS. 3 and 4.

In the area of the mixing portion 11, the shaft is provided with mixing elements 14 which are embodied as hedgehog-type wings. These wings are narrower than the wings of the conveying elements 13. Their width is approximately half of the diameter of the shaft 8. The wings of the mixing elements 14 are also positioned at an angle relative to the cross-section of the shaft 8. It is a special feature that the angular position of some of the mixing elements 14 is oriented in the opposite direction. This is illustrated with those mixing elements 14 in FIG. 4 which, from the viewer's perspective, project toward the viewer. It can be noticed that the first three wing-shaped mixing elements 14 are positioned opposite the conveying elements 13 as viewed in the conveying direction, while the remaining two mixing elements 14 are provided with the same positioning angle as the conveying elements 13.

Finally, the tube 5 of the mixing portion 11 is provided at its upper surface portion with a water supply opening 15 connected to a water metering device 16 arranged upstream. The pan-shaped casing 4 is provided with another water inlet opening 17 for cleaning purposes.

The container for mortar operates as follows: The mortar produced in the manufacturing plant has a fixedly predetermined standard consistency and is transported to the construction site in the storage container 2. The distribution of the mortar from the storage container 2 is effected by means of the conveying and mixing pump 3. In order to create the desired mortar consistency, a very low amount of water is added to the mortar via the water supply opening 15 in the mixing portion 11. The water metering device 16 arranged upstream is used for this purpose and is equipped with very small dimensioned needle valves of flow meters. The reason for this is that a very low amount of water of approximately 10 to 20 liters per hour is required. This low amount of water is injected into the mixing portion 11 via the water supply opening 15 and is thus added to the mortar. The mixing procedure is performed by the hedgehog-type mixing elements 14. As mentioned earlier, some of the mixing elements 14 are positioned on the shaft 8 at an opposite angular orientation relative to the wing-shaped conveying elements 13 such that they produce a slightly counter-acting conveying action which increases the mixing degree altogether. After passing through the distribution portion 12, the mortar with the desired consistency arrives at the distribution opening 7. From there, the mortar can be distributed via a hose to the desired location.

The inventive method warrants that the mortar delivered in a standard consistency can be optimized with respect to its mortar consistency in a technically simple manner.

The present invention is, of course, in no way restricted to the specific disclosure of the specification and drawings, but also encompasses any modifications within the scope of the appended claims.

What is claimed is:

1. A method for providing a paste-like building material at construction sites, comprising the steps of:

producing in a manufacturing plant a base material in the form of a paste-like building material having a fixedly pre-determined basic viscosity;

transporting said paste-like building material in a storage container from the manufacturing plant to a construction site;

continuously conveying said paste-like building material with a conveying and mixing pump connected to the storage container to a distribution opening; and during the step of continuously conveying, continuously adding and mixing as needed amounts of water, added by a water metering device via a water supply opening, to said paste-like building material having said basic viscosity to decrease said basic viscosity of said paste-like building material to a desired viscosity for use in construction.

2. The method according to claim 1, wherein adding said amounts of water comprises metering said amounts of water into said paste-like building material.

* * * * *